US010285446B2

(12) United States Patent
Xu

(10) Patent No.: US 10,285,446 B2
(45) Date of Patent: May 14, 2019

(54) MICROVAPORIZER WITH CONTROLLED ACTIVATION

(71) Applicant: Yongjie James Xu, Richmond, VA (US)

(72) Inventor: Yongjie James Xu, Richmond, VA (US)

( * ) Notice: Subject to any disclaimer, the term of this patent is extended or adjusted under 35 U.S.C. 154(b) by 30 days.

(21) Appl. No.: 15/583,797

(22) Filed: May 1, 2017

(65) Prior Publication Data

US 2018/0310619 A1 Nov. 1, 2018

(51) Int. Cl.

| | |
|---|---|
| ***A24F 13/00*** | (2006.01) |
| ***A24F 47/00*** | (2006.01) |
| ***H05B 1/02*** | (2006.01) |

(52) U.S. Cl.

CPC ..... *A24F 47/008* (2013.01); *H05B 1/0244* (2013.01); *H05B 2203/021* (2013.01)

(58) Field of Classification Search

CPC ..... A24F 47/008

USPC ..... 131/328, 329

See application file for complete search history.

(56) References Cited

U.S. PATENT DOCUMENTS

| | | | | |
|---|---|---|---|---|
| 9,642,397 | B2 * | 5/2017 | Dai | A61M 15/06 |
| 2014/0283855 | A1 | 9/2014 | Hawes et al. | |
| 2015/0128967 | A1 * | 5/2015 | Robinson | A24F 47/008 131/328 |
| 2015/0157054 | A1 * | 6/2015 | Liu | A24F 47/008 131/329 |
| 2018/0084829 | A1 * | 3/2018 | Xu | A24F 47/008 |

* cited by examiner

*Primary Examiner* — Phuong K Dinh

(74) *Attorney, Agent, or Firm* — Nixon & Vanderhye P.C.

(57) ABSTRACT

A microvaporizer having a first switch connected to a mouthpiece of the microvaporizer and a timer, and a second switch that is connected to the timer and the battery of the microvaporizer. The microvaporizer is activated to produce vapor when the first switch is triggered and the second switch is also triggered within the timer's countdown of a predetermined period of time. When the second switch is not triggered before the timer countdown ends, the timer turns off automatically and the microvaporizer is not activated.

18 Claims, 4 Drawing Sheets

MICROVAPORIZER WITH CONTROLLED ACTIVATION

This invention relates to a portable microvaporizer, in particular an electronic cigarette device that produces vapor to a user.

BACKGROUND OF THE INVENTION

Microvaporizers, such as electronic cigarettes ("e-cigarettes"), generally include a mouthpiece, a fluid tank that holds the vaporization fluids ("e juice"), a heating element, and a battery. Some may include other components, such as holes for air intake and air pressure sensor. Microvaporizers are generally activated ("turned on") by triggering a switch that is connected to an air pressure sensor or by pressing an "on" button on the microvaporizer. Typically, after a microvaporizer is turned on, it does not turn off automatically. It is assumed that the microvaporizer is in use when activated.

A user usually activates the e-cigarette when it is intended to be used. The activation triggers the heating element to start heating and the stored fluid to flow from the tank to the heating element, and produces vapor to be delivered to the user. The commercially available e-cigarettes are typically turned on by pushing a button on the e-cigarette to start the heating element preheating process. A second switch, such as a second button or an airflow switch, is subsequently activated to draw the stored fluid from the tank to the preheated heating element. Because the two steps require separate actions from the user, this two-step process creates a delay between starting the e-cigarette and receiving vapor.

Sometimes, the e-cigarette may be activated unintentionally. If the user accidentally pushes the switch button without noticing, the e-cigarette may continuously draw energy from the battery to power the heating element. The heating element can overheat from not receiving the stored fluid, or can produce undesired vapor using the stored fluid and deplete the stored fluid. The undesired vapor can also cause burning.

It is likely for a user to put an inactivated e-cigarette in his/her pocket to transport the e-cigarette, along with other miscellaneous items. Because of the user's movements, the miscellaneous items can accidently hit the "on" button on the e-cigarette while the user is walking. The user might not notice that the e-cigarette is turned on and continues to walk with the activated e-cigarette in his or her pocket. In the scenario that the heating element does not receive stored fluid from the tank, the user may be burned by the overheated e-cigarette in his or her pocket. In the scenario that the second switch in the e-cigarette is also accidentally activated so that the heating element does receive fluids from the tank and creates vapor, then the user may be burned by the preheated heating element and the vapor produced by the e-cigarette in his or her pocket.

BRIEF SUMMARY OF THE INVENTION

Activated microvaporizers, such as an e-cigarette, if unattended, can potentially create health hazards and injuries related to heat. Embodiments of an improved microvaporizer that includes a safety feature that controls activation are described herein. The mouthpiece portion of the e-cigarette, such as the portion that a user's lips would touch, is provided with a first switch. The first switch is connected to a timer that is set to countdown a predetermined short period of time. The timer is connected to a second switch, which is coupled to the battery. The second switch activates the battery to deliver power to the heating element and allow vaporization. The second switch can also be coupled to a fluid flow mechanism that delivers stored fluid from the tank to the heating element.

When the user's lips touch the mouthpiece with the conductive material to use the microvaporizer, the mouthpiece triggers the first switch to turn on the timer but does not activate the heating element. The timer is connected to the first switch, and starts to countdown a predetermined short period of time starting from when the first switch is triggered. A second switch, such as an airflow switch or a button, is required to turn on the heating element. If the second switch is not activated within the predetermined short period of time, i.e. before the timer countdown finishes, then the timer is turned off and the microvaporizer is returned to a completely inactive state.

An embodiment of the improved microvaporizer includes a mouthpiece, a first switch connected to a timer which is triggered by the first switch to start a countdown for a predetermined period of time, a second switch connected to the timer and configured to be triggered during timer countdown, a battery connected to the timer and the second switch, and a heating element connected to the battery.

If a user activates an embodiment microvaporizer intentionally, a method to activate an embodiment microvaporizer includes touching a mouthpiece of the microvaporizer, triggering a first switch attached to the mouthpiece, turning on a timer to countdown a predetermined period of time when the first switch is triggered, and determining whether a second switch on the microvaporizer is triggered during the timer countdown. If the second switch is triggered within the predetermined time, then the method further includes activating the microvaporizer to send power from a battery to the heating element.

In the scenario that a microvaporizer was turned on accidently and unintentionally, steps to control activation of the embodiment microvaporizer includes touching a mouthpiece of the microvaporizer, triggering a first switch attached to the mouthpiece, turning on a timer to countdown a predetermined period of time when the first switch is triggered, taking no action to trigger a second switch in the microvaporizer, and turning off the timer automatically when the countdown ends.

The improved e-cigarette provides an extra safety feature by setting a short window of time in which both of the first and second switches have to be activated in sequence. The unlikely scenario of activating both switches within the predetermined short period of time greatly reduces the risk of accidental and unintentional activation of an e-cigarette.

DETAILED DESCRIPTION OF THE INVENTION

The improved microvaporizers described herein include a safety control process to prevent accidental and unintentional activations of a microvaporizer, e.g., an e-cigarette. The improved e-cigarette includes a first switch controlled by a timer, and a second switch that is intended to be activated within the timer countdown.

The first switch can be a touch switch, such as a capacitance switch, a resistance touch switch, a piezo touch switch, or any other similar switches. The first switch can also be a sensor that registers deformation of the mouthpiece, such as any of the different types of pressure sensor, shape sensor, force sensor, or any other equivalents that can sense changes in the shape of the mouthpiece. The first switch can further be a temperature sensor that triggers the switch when the temperature sensor registers a predetermined temperature, such as an average human body temperature. The first switch can also be a simple conductive material that is embedded into, or layered on, the mouthpiece. The second switch can be an airflow switch or a button switch on the microvaporizer.

Figure 1A:
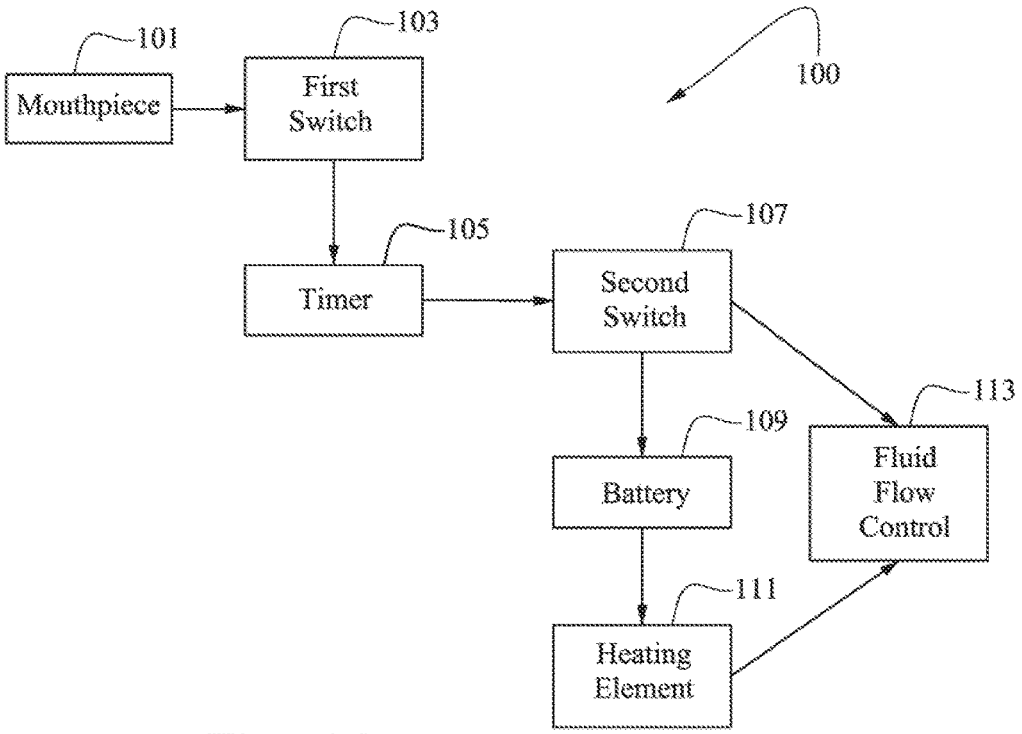
FIG. 1A is a diagram of the connections between different components in an embodiment microvaporizer, in which the fluid flow mechanism is not connected to the battery.

The connections between the components are shown in the diagram in FIG. 1. An embodiment e-cigarette 100 includes a first switch 103 in the mouthpiece 101. The first switch 103 is triggered when the user touches the mouthpiece 101. To prevent accidental and unintentional activation, the first switch 103 is connected to a timer 105 that counts down a predetermined period of time starting when the first switch 103 is triggered. The timer 105 can be set to countdown between about 1 to 5 seconds or 1 to 3 seconds, before the timer is switched off automatically when the countdown ends.

If a second switch 107 in the e-cigarette 100 is triggered within the predetermined period of time, i.e. before the timer countdown finishes, then the e-cigarette 100 is activated and the heating element 111 in the e-cigarette 100 starts to receive power from the battery 109. If the second switch 107 is not triggered within the predetermined time, then the timer 105 automatically stops after the countdown ends, and the e-cigarette 100 is not activated. In an embodiment, the second switch 107 is also connected to a fluid flow mechanism 113 in the e-cigarette 100, such that when the second switch 107 is triggered, the second switch 107 activates the battery 109 to power the heating element 111 and activates the fluid flow mechanism 113 to deliver stored fluid to the heating element 111 for vaporization. In this embodiment, the fluid flow mechanism 113 is not connected to or powered by the battery 109. When the second switch 107 is triggered, the fluid flow mechanism 113 is activated mechanically without the use of electricity.

Figure 1B:
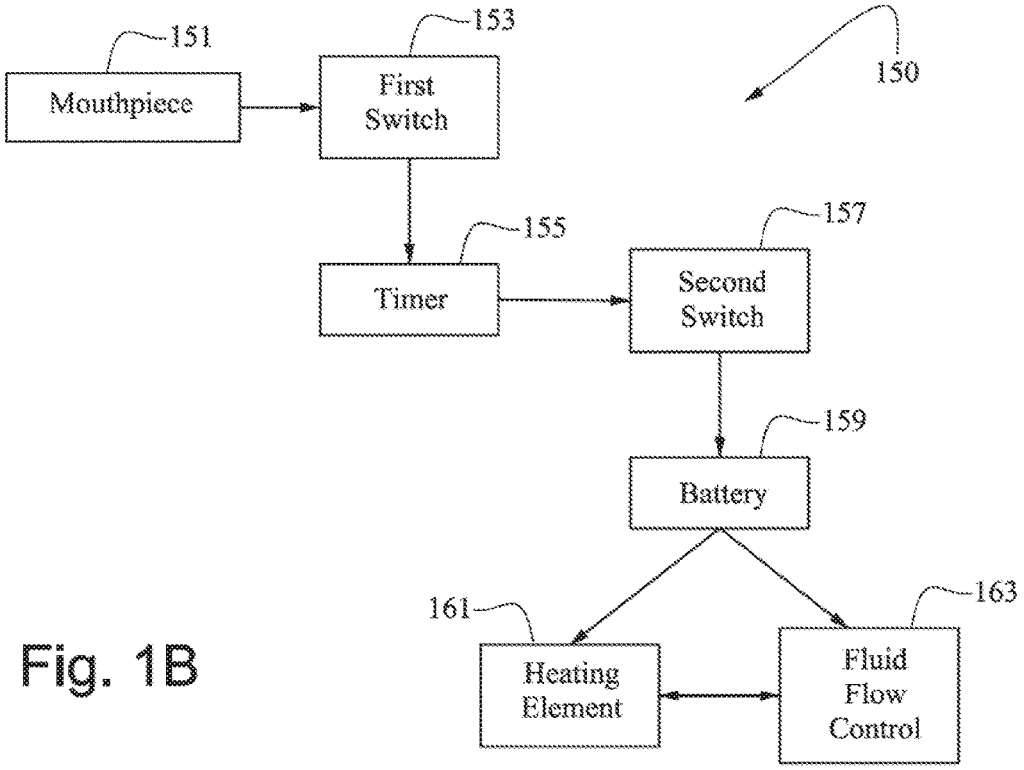
FIG. 1B is a diagram of the connections between different components in another embodiment microvaporizer, in which the fluid flow mechanism is connected to the battery.

In another embodiment, shown in FIG. 1B, a mouthpiece 151 in an e-cigarette 150 is connected to a first switch 153, which is connected to a timer 155. The timer 155 controls the e-cigarette activation by counting down a predetermined period of time, such as between about 1 to 5 seconds or 1 to 3 seconds, within which the second switch 157 needs to be triggered to turn on the e-cigarette. The second switch 157 is connected to the battery 159. In this embodiment, the fluid flow mechanism 163 is connected to the battery 159 such that the fluid flow mechanism 163 is powered by the battery 159. In this embodiment, the second switch 157 is only connected to the battery 159 to control power supply to both the heating element 163 and the fluid flow mechanism 163 in the e-cigarette 150.

In both of the embodiments, the fluid flow mechanism can be a pipe having a small diameter that does not allow fluid to be transported without inducing pressure, a flow valve, a wick, or any equivalents that can transport fluid from the tank to the heating element in a controlled amount.

Figure 2:
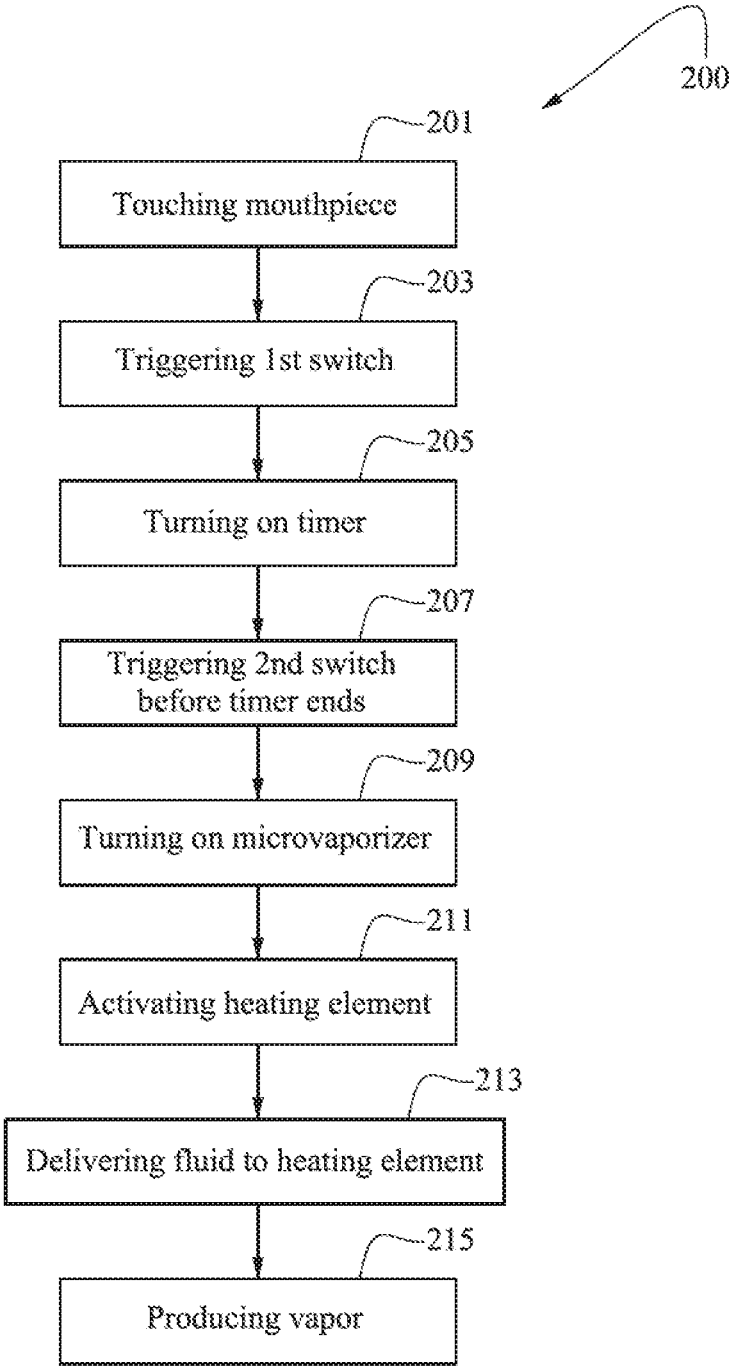
FIG. 2 is a diagram of a process to activate an embodiment microvaporizer intentionally, by triggering two switches and a timer in sequence and within a predetermined time.
Figure 3:
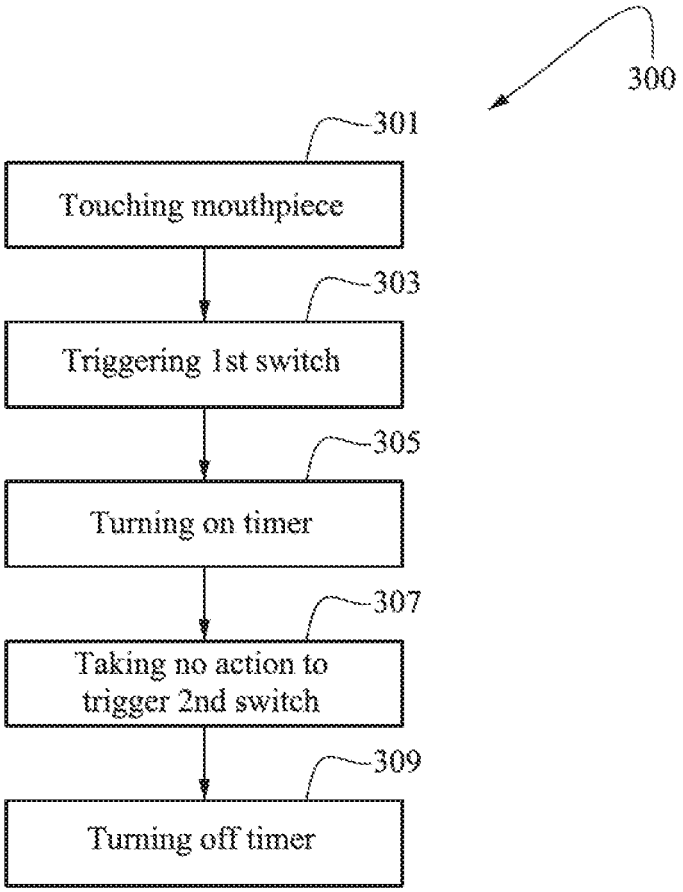
FIG. 3 is a diagram of a process to control and annul the activation of an embodiment microvaporizer when it is unintentionally activated.

When a user intentionally uses an embodiment e-cigarette to receive vapor, the activation process 200 is shown in FIG. 2. The process begins when the user touches the mouthpiece 201, which triggers a first switch 203. The first switch, connected to a timer, and turns on the timer 205 when the first switch is triggered 203. The timer counts down a predetermined time starting from when the first switch is triggered 203. Then, the user triggers a second switch before the timer finishes counting 207, the second switch turns on the microvaporizer 209, such as an e-cigarette, to allow the heating element to activate 211 by receiving power from the battery in the e-cigarette. In an embodiment, the second switch also activates a fluid flow mechanism when the heating element is activated 211, either mechanically or by receiving power from the battery. When fluid flow mechanism delivers stored fluid to the heating element 213, the heating element produces vapor 215 that is subsequently delivered to the user.

The embodiment e-cigarette can also reduce time delay between activation and fluid delivery by allowing the user to trigger the first switch and the second switch in one user action, such as providing suction to the mouthpiece. In an embodiment microvaporizer in which the second switch is an airflow switch, the activation process 200 eliminates the delay between preheating and fluid delivery because the microvaporizer can be fully activated by the user immediately after suction is applied, for example, when a user puts his lips on the mouthpiece and take in a breath through the mouthpiece ("taking a puff") to receive vapor.

In this process, the first switch and timer are triggered when the user puts his or her lips on the mouthpiece, and the airflow switch is immediately triggered thereafter when the user takes in a breath through, or sucks on, the mouthpiece of the microvaporizer. The airflow switch turns on the microvaporizer to activate the heating element, and activates the fluid flow mechanism to deliver stored fluid from the tank to the heating element at the same time. The fluid flow mechanism delivers fluid, for example, by the induced negative pressure in the mouthpiece as compared to the fluid tank, or by opening a flow valve. Thus, vapor can be produced within a very short period of time, or immediately, after the user takes a puff through the mouthpiece.

The process can be described in terms of a sequence of steps to activate an e-cigarette intentionally, which includes: touching a mouthpiece of the microvaporizer, triggering a first switch attached to the mouthpiece, turning on a timer to countdown a predetermined period of time when the first switch is triggered, and determining whether a second switch on the microvaporizer is triggered during the timer countdown. If the second switch is triggered, then the steps also include activating the microvaporizer and turning on the heating element when the second switch is triggered.

If an embodiment microvaporizer is turned on unintentionally, i.e. the user did not intentionally take steps to facilitate production of vapor, then an annulment process 300 occurs, which acts as a safety measure to ensure that the microvaporizer is not activated. In the scenario that the mouthpiece is touched by a user or an object and triggers the first switch 303, the timer is turned on 305 and starts counting down a predetermined period of time. If no action is taken to trigger a second switch 307, the timer turns off automatically 309 to return the microvaporizer to an inactive state.

Using the improved e-cigarette, the user has to engage two switches within a predetermined period of time, such as between about 1 to 5 seconds, or about 1 to 3 seconds, to activate the e-cigarette. This procedure improves the safety of transporting an e-cigarette because even if the first switch is unintentionally triggered, the combination of the timer and the second switch makes it less likely for the e-cigarette to fully activate and to deliver power to the heating element, thus reduces the risks of accidental and unintentional activation of the e-cigarette.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. A microvaporizer comprising:

a mouthpiece;

a first switch on or in the mouthpiece and configured to be activated by a user touching the mouthpiece;

a timer configured to start a count of a certain period in response to the first switch being activated by the user;

a second switch connected to the timer and configured to be activated by the user;

a battery connected to the timer and the second switch;

a liquid chamber, and a heating element connected to the battery, wherein the heating element is powered by the battery and activated only if the second switch is activated by the user within the certain period, wherein the activation of the heating element vaporizes a liquid drawn from the liquid chamber to the heating element.

2. The microvaporizer of claim 1, wherein the heating element is configured to receive power from the battery when the second switch is activated.

3. The microvaporizer of claim 1 further comprising a fluid flow control that is directly activated by the second switch, without receiving power from the battery.

4. The microvaporizer of claim 3 wherein the fluid flow control is connected to and receives power from the battery.

5. The microvaporizer of claim 1, wherein the second switch is inhibited from being activated except during the count of the predetermined period.

6. The microvaporizer of claim 1, wherein the first switch is a touch sensor, a deformation sensor, a conductive material, or a combination thereof.

7. The microvaporizer of claim 1, wherein the second switch is a button on a housing for the microvaporizer or an airflow switch connected to a flow passage extending through the mouth piece and to the heating element.

8. The microvaporizer of claim 1, wherein the timer is configured to turn off automatically when the second switch is not activated within the certain period.

9. A method of activating a microvaporizer, comprising:

touching a mouthpiece of the microvaporizer;

triggering a first switch attached to the mouthpiece by the touch to the mouthpiece;

starting a count of a predetermined period in response to the triggering of the first switch; determining whether a second switch on the microvaporizer is triggered during the countdown;

only if the second switch is triggered during the predetermined period, activating a heating element in the microvaporizer to generate heat energy;

vaporizing a liquid in the microvaporizer by applying the heat energy to the liquid heating the with the heated heating element, and directing the vaporized liquid through the mouthpiece.

10. The method of claim 9 further comprising inhibiting activation of the heating element unless the second switch is triggered during the predetermined period.

11. The method of claim 9 further comprising delivering the liquid from a stored fluid from a tank of the microvaporizer to the heating element.

12. The method of claim 9 further comprising inhibiting activation of the heating element promptly after expiration of the predetermined period and until the mouthpiece is again touched.

13. The method of claim 9, wherein the predetermined period is in a range of 1 to 5 seconds.

14. A method for using a microvaporizer comprising:

detecting a user's touch of a mouthpiece of the microvaporizer;

detecting an activation of a switch by the user, wherein the switch is at a section of a casing of the microvaporizer other than the mouthpiece;

only if a period between the detection of the user's touch on the mouthpiece and the activation of the switch is within a certain period, activating a heating element in the microvaporizer to generate heat energy;

applying the generated heat energy to vaporize a vaporization liquid stored in the microvaporizer, and directing the vaporized vaporization liquid to an outlet of the microvaporizer.

15. The method of claim 14, wherein the detection of the user's touch is performed using at least one of a touch sensor, a deformation sensor, and a conductive material mounted to the mouthpiece.

16. The microvaporizer of claim 14, wherein the switch is a button on an outer surface of the casing or an airflow switch within an air passage in the casing.

17. The method of claim 14, wherein the predetermined period is in a range of 1 to 5 seconds.

18. The method of claim 14 wherein the step of directing includes directly the vaporized vaporization liquid through a mouthpiece and the outlet is an outlet of the mouthpiece.

* * * * *